US007536145B2

(12) United States Patent
Tomine et al.

(10) Patent No.: US 7,536,145 B2
(45) Date of Patent: May 19, 2009

(54) IMAGE HEATING APPARATUS

(75) Inventors: Jun Tomine, Abiko (JP); Ryo Hanashi, Moriya (JP); Koto Arimoto, Abiko (JP); Taisuke Matsuura, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/530,563

(22) Filed: Sep. 11, 2006

(65) Prior Publication Data

US 2007/0059012 A1 Mar. 15, 2007

(30) Foreign Application Priority Data

Sep. 13, 2005 (JP) ..... 2005-265879

(51) Int. Cl.
*G03G 15/20* (2006.01)

(52) U.S. Cl. ..... 399/328; 399/33; 399/45; 399/69; 399/92; 399/94

(58) Field of Classification Search ..... 399/33, 399/45, 69, 92, 94, 328
See application file for complete search history.

(56) References Cited

U.S. PATENT DOCUMENTS

| | | | | |
|---|---|---|---|---|
| 5,148,226 | A | 9/1992 | Setoriyama et al. | 355/290 |
| 5,210,579 | A | 5/1993 | Setoriyama et al. | 355/285 |
| 5,525,775 | A | 6/1996 | Setoriyama et al. | 219/216 |
| 5,742,865 | A * | 4/1998 | Yajima et al. | 399/43 |
| 5,787,321 | A * | 7/1998 | Nishikawa et al. | 399/69 |
| 6,754,458 | B2 * | 6/2004 | Makihira | 399/92 |
| 7,098,430 | B2 * | 8/2006 | Kondo et al. | 219/619 |
| 7,122,769 | B2 * | 10/2006 | Nami et al. | 219/619 |
| 2001/0048822 | A1 * | 12/2001 | Hanyu et al. | 399/67 |
| 2005/0180787 | A1 * | 8/2005 | Nami et al. | 399/328 |
| 2005/0220467 | A1 * | 10/2005 | Takahashi et al. | 399/45 |
| 2007/0059010 | A1 | 3/2007 | Arimoto et al. | 399/69 |
| 2007/0059021 | A1 | 3/2007 | Hanashi et al. | 399/92 |

FOREIGN PATENT DOCUMENTS

JP 60-136779 7/1985

(Continued)

OTHER PUBLICATIONS

Translation of JP 04051179, by The Mcelroy Translation Company, Mar. 2008.*
Machine translation of JP 05-181382.

*Primary Examiner*—David M Gray
*Assistant Examiner*—Ryan D Walsh
(74) *Attorney, Agent, or Firm*—Fitzpatrick, Cella, Harper & Scinto

(57) ABSTRACT

An image heating apparatus including: an image heating member, which heats an image on a recording material in a nip portion; an air blower, which blows air toward an air blowing port to cool a predetermined area of the image heating member; and a shutter, which opens and closes the air blowing port, in which the shutter is kept at a closed position when a temperature of the predetermined area of the image heating member is equal to or lower than a predetermined temperature, whereby a temperature rise in a non-sheet passing portion can be efficiently reduced by using the small air blower without lowering the productivity when small-size recording materials are continuously passed nor reducing the lifetime of the air blower.

5 Claims, 14 Drawing Sheets

FOREIGN PATENT DOCUMENTS

| | | | | |
|---|---|---|---|---|
| JP | 4-44075 | | | 2/1992 |
| JP | 4-44076 | | | 2/1992 |
| JP | 4-44077 | | | 2/1992 |
| JP | 4-44078 | | | 2/1992 |
| JP | 4-44079 | | | 2/1992 |
| JP | 4-44080 | | | 2/1992 |
| JP | 4-44081 | | | 2/1992 |
| JP | 4-44082 | | | 2/1992 |
| JP | 4-44083 | | | 2/1992 |
| JP | 04051179 | A | * | 2/1992 |
| JP | 4-204980 | | | 7/1992 |
| JP | 4-204981 | | | 7/1992 |
| JP | 4-204982 | | | 7/1992 |
| JP | 4-204983 | | | 7/1992 |
| JP | 4-204984 | | | 7/1992 |
| JP | 5-181382 | | | 7/1993 |
| JP | 05181382 | A | * | 7/1993 |
| JP | 2002287564 | A | * | 10/2002 |

* cited by examiner

IMAGE HEATING APPARATUS

BACKGROUND OF THE INVENTION

1. Field of the Invention

The present invention relates to an image heating apparatus for heating an image formed on a recording material. Examples of the image heating apparatus include, for example, a fixing apparatus for fixing an unfixed image on the recording material, and a gloss improving apparatus for improving gloss of an image by heating an image fixed on the recording material. The image heating apparatus is used in an image forming apparatus such as a copying machine, a printer, a facsimile, and a composite machine having a plurality of functions thereof.

2. Description of the Related Art

Up to now, in such the image forming apparatus, as a fixing method of fixing an unfixed toner image on a recording material, a thermal fixing method in which an unfixed toner image is heated and fused to be fixed on the recording material is generally used in view of safety and excellent fixing property.

In particular, in view of excellent thermal efficiency, easiness of down-sizing, and the like, most widely used is a heat fixing apparatus for thermally-fixing an unfixed toner image by heating and pressurizing after transporting the recording material while being sandwiched on a fixing area in which a heating rotary member and a pressure rotary member are in pressure-contact with each other.

In recent years, such the fixing apparatus becomes more diversified to allow passage of recording materials of various sizes, for example, from a relatively large-size recording material such as in A3 size to the most commonly used small-size recording material such as in A4R or B5 size. Therefore, it is necessary to configure the lengths of the heating rotary member and the pressure rotary member in an axial direction to correspond to the relatively large size such as the A3 size.

For the use of the configuration as described above, however, a non-sheet passing area in an effective fixation area of the heating rotary member, through which the recording material does not pass, becomes larger when the small-size recording material such as in A4R or B5 passes through the fixing apparatus. Then, when the small-size recording materials are continuously passed, a so-called non-sheet passing portion temperature rise phenomenon that a surface temperature of the non-sheet passing area becomes extremely high occurs because the recording material does not draw heat from the surface of the heating rotary member corresponding to the non-sheet passing area.

As techniques of coping with the non-sheet passing portion temperature rise, means 1) to 3) as described below are known.

1) A heat supply to the heating rotary member is stopped between a recording material and a recording material to idle the heating rotary member to lower the surface temperature of the heating rotary member in the non-sheet passing area to be equal to the surface temperature in a sheet passing area (throughput down control).

According to the countermeasure 1), however, since the idling for cooling the heating rotary member is required between a recording material and a recording material when the small-size recording materials are continuously passed or the like, there arises a problem in that the productivity for passing the small-size recording materials is lowered.

2) A light distribution ratio of heating means such as a heater provided in the heating rotary member is varied to make a heat quantity supplied to the non-sheet passing area smaller than that supplied to the sheet passing area for fixing the small-size recording material.

For the use of the configuration as described in 2), however, the arrangement of a heater having a plurality of light distribution ratios is required for the compatibility with a plurality of sizes, resulting in increased size of the fixing apparatus. Therefore, the number of compatible sizes is limited.

In order to cope with the problem, apparatuses described in JP S60-136779 A and JP H05-181382 A cool a non-sheet passing area with a cooling air to prevent an excessive temperature rise in the non-sheet passing area when the small-size recording material is passed.

In the configuration of the conventional example, however, the heating rotary member and a cooling fan are in communication with each other even from the start of an image forming job. Therefore, there is a possibility that an ambient temperature of the cooling fan excessively rises to thermally degrade the cooling fan. To be specific, if the ambient temperature of the cooling fan becomes higher than a resistance temperature of a sliding bearing used for the fan against oil heat or a bonding temperature of a driver IC, there arises a problem in that the cooling fan breaks down or the lifetime of the cooling fan is shortened.

As a result, the lifetime of the cooling fan is disadvantageously shortened to increase the maintenance cost required for replacing the cooling fan or the like.

SUMMARY OF THE INVENTION

An object of the present invention is to provide an image heating apparatus capable of suppressing degradation of air blowing means, which is caused by heat.

According to one aspect of the invention, an image heating apparatus includes: an image heating member, which heats an image formed on a recording material in a nip portion; air blowing means for blowing air toward an air blowing port to cool a predetermined area of the image heating member; and a shutter, which opens and closes the air blowing port, wherein the shutter is kept at a closed position when a temperature of the predetermined area of the image heating member is equal to or lower than a predetermined temperature.

According to another aspect of the invention, an image heating apparatus includes: an image heating member, which heats an image formed on a recording material in a nip portion; air blowing means for blowing air toward an air blowing port to cool a predetermined area of the image heating member; and a shutter, which opens and closes the air blowing port, wherein the shutter is kept at a closed position until the number of recording materials having passed through the nip portion reaches a predetermined number when an image heating process is performed on the recording material having a predetermined width.

According to another aspect of the invention, an image heating apparatus includes: an image heating member, which heats an image formed on a recording material in a nip portion; air blowing means for blowing air toward an air blowing port to cool a predetermined area of the image heating member; and a shutter, which opens and closes the air blowing port, wherein the shutter is kept at a closed position from a start of an image heating process to a start of an operation of the air blowing means.

Further features of the present invention will become apparent from the following description of exemplary embodiments with reference to the attached drawings.

DESCRIPTION OF THE EMBODIMENTS

Hereinafter, the present invention will be described in detail by referring to embodiments. It should be noted that the embodiments are examples of best embodiment modes of the present invention. However, the present invention is not limited to a variety of constitutions described in the embodiments. In other words, the variety of constitutions described in the embodiments can be replaced with another well-known constitution within a scope of an idea of the present invention.

First Embodiment (1) Image Forming Portion

Figure 2:
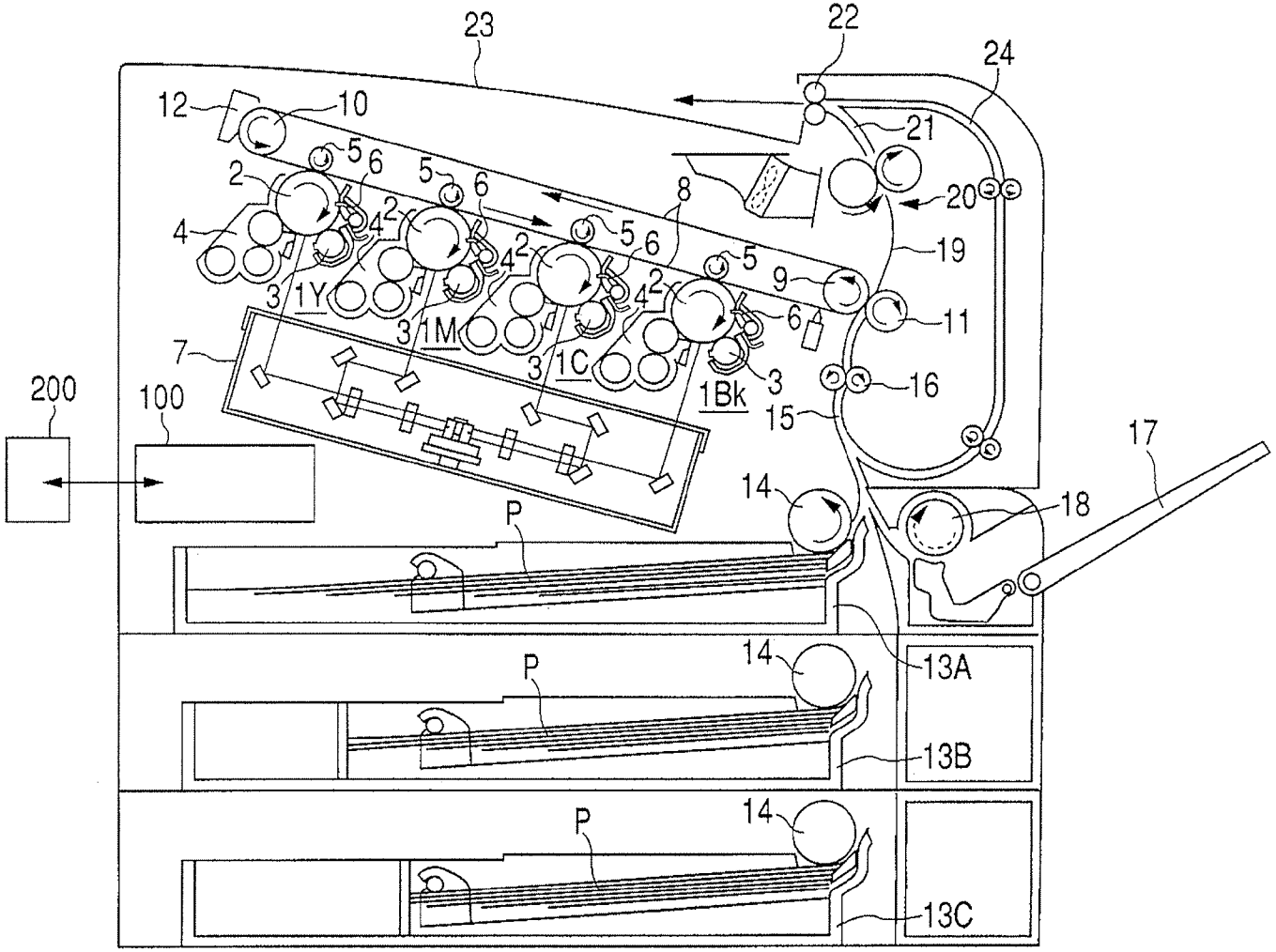
FIG. 2 is a longitudinal sectional view schematically showing an example of an image forming apparatus mounted with the fixing apparatus.

FIG. 2 is a longitudinal sectional view schematically showing a structure of an electrophotographic full-color printer which is an example of an image forming apparatus mounted with an image heating apparatus according to the present invention as a fixing apparatus. First, an outline of an image forming portion will be described.

This printer performs an image forming operation according to input image information from an external host device 200 connected to a control circuit portion (i.e., control substrate; CPU) 100 so as to communicate with each other, thereby making it possible to form a full-color image on a recording material and output the formed full-color image.

The external host device 200 is a computer, an image reader, or the like. The control circuit portion 100 transmits/receives a signal to/from the external host device 200. In addition, the control circuit portion 100 transmits/receives a signal to/from a variety of image forming devices and controls an image formation sequence.

An intermediate transfer belt (hereinafter, briefly referred to as "belt") 8, which is an endless flexible belt, is stretched around a secondary transferring opposing roller 9 and a tension roller 10. The intermediate transfer belt 8 is rotationally driven counterclockwise as indicated by the arrows at a predetermined speed by a drive of the secondary transferring opposing roller 9. A secondary transfer roller 11 is brought into pressure-contact with the secondary transferring opposing roller 9 through the belt 8. An abutting portion between the belt 8 and the secondary transferring roller 11 is a secondary transferring portion.

A first image forming portion 1Y, a second image forming portion 1M, a third image forming portion 1C, and a fourth image forming portion 1Bk are arranged in a line on a lower side of the belt 8 at predetermined intervals along a belt movement direction. The image forming portions each have an electrophotographic process mechanism of a laser exposure system, and have a drum-type electrophotographic photosensitive member (hereinafter, briefly referred to as "drum") 2 serving as an image bearing member which is rotationally driven clockwise as indicated by the arrow at a predetermined speed. On the periphery of each drum 2, a primary charger 3, a developing device 4, a transferring roller 5 serving as a transferring means, and a drum cleaning device 6 are arranged. Each transferring roller 5 is arranged inside the belt 8, and is brought into pressure-contact with the corresponding drum 2 through the belt 8. An abutting portion between each drum 2 and the belt 8 is a primary transferring portion. A laser exposure device 7 opposing the drum 2 of each of the image forming portions is constituted of a laser emitting means for emitting light corresponding to a time-series electric digital image signal of given image information, a polygon mirror, a reflecting mirror, and the like.

The control circuit portion 100 causes each of the image forming portions to perform an image formation operation based on a color separated image signal inputted from the external host device 200. As a result, in the first to fourth image forming portions 1Y, 1M, 1C, and 1Bk, color toner images for Yellow, Magenta, Cyan, and Black are formed on the respective surfaces of the rotating drums 2 at a predetermined control timing. It should be noted that the principle and process of the electrophotographic image formation in which toner images are formed on the drums 2 are well-known, so the description thereof will be omitted.

The toner images formed on the respective surfaces of the drums 2 of the image forming portions are superimposed on top of each other to be sequentially transferred onto an outer surface of the belt 8 which is rotationally driven in a forward direction with respect to a rotation direction of each drum 2 at a speed corresponding to the rotation speed of each drum 2 in the primary transferring portion. As a result, four toner images formed on the surface of the belt 8 are superimposed on top of each other to be synthesized to form an unfixed full-color toner image.

On the other hand, at a predetermined sheet feeding timing, a sheet feeding roller 14, which is provided on a feed cassette on a stage selected among vertical multi-stage cassette sheet feeding portions 13A, 13B, and 13C for stacking and containing recording materials P each having a variety of width sizes, is driven. As a result, the recording materials P staked and contained in the sheet feed cassette on the stage are separately fed one by one through a vertical transport path 15, and are transported to registration rollers 16. When a manual sheet feeding is selected, a sheet feed roller 18 is driven. Thus, one sheet of the recording materials set to be stacked on a manual feed tray (i.e., multi-purpose tray) 17 is separately fed through the vertical transport path 15 to be transported to the registration rollers 16.

The registration rollers 16 transport the recording material P at a predetermined timing so that a leading edge of the recording material P reaches the secondary transferring portion at a timing when a leading end of the full-color toner image formed on the rotating belt 8 reaches the secondary transferring portion. As a result, in the secondary transferring portion, the full-color toner images formed on the belt 8 are collectively and sequentially secondarily-transferred on a surface of the recording material P. The recording material P, after passing the secondary transferring portion, is separated from the surface of the belt 8, is guided into a vertical guide 19, and is introduced into a fixing apparatus (i.e., fixing device) 20. By the fixing apparatus 20, the multiple-color toner images are fused to be mixed, and are fixed on the surface of the recording material as a permanent fixed image. The recording material P, which has passed the fixing apparatus 20, is fed onto a delivery tray 23 as a full-color image product by delivery rollers 22 through a transport path 21.

In the secondary transferring portion, the surface of the belt 8 after being separated from the recording material is cleaned by removing residual matters such as secondary transfer residual toner by a belt cleaning device 12, so the surface of the belt 8 can be repeatedly used for image formation.

In a monochrome printing mode, only the fourth image forming portion Bk for forming a black toner image is controlled to perform an image formation operation. When a two-side printing mode is selected, a recording material, a first surface of which has been printed, is fed onto the delivery tray 23 by the delivery rollers 22. At a time point immediately before a trailing edge of the recording material passes the delivery rollers 22, the rotation of the delivery rollers 22 is converted into a negative rotation. As a result, the recording material is switched back and is introduced into a re-transport path 24. Then, the surface of the recording material is turned over to be transported to the registration rollers 16 again. After that, in a similar manner as in the printing of the first surface, the recording material is transported to the secondary transferring portion and to the fixing apparatus 20, and is then fed onto the delivery tray 23 as a two-side printing image forming product.

(2) Fixing Apparatus 20

In the following description, in a fixing apparatus or a member constituting the fixing apparatus, a longitudinal direction indicates a direction parallel to a direction perpendicular to a recording material transport direction within a surface of a recording material transport path. As regards the fixing apparatus, a front surface thereof indicates a surface at a recording material introducing side, and left or right thereof indicates left or right when the apparatus is viewed from the front surface. A width of the recording material indicates a size of the recording material in a direction perpendicular to the recording material transport direction on the surface of the recording material.

Figure 1:
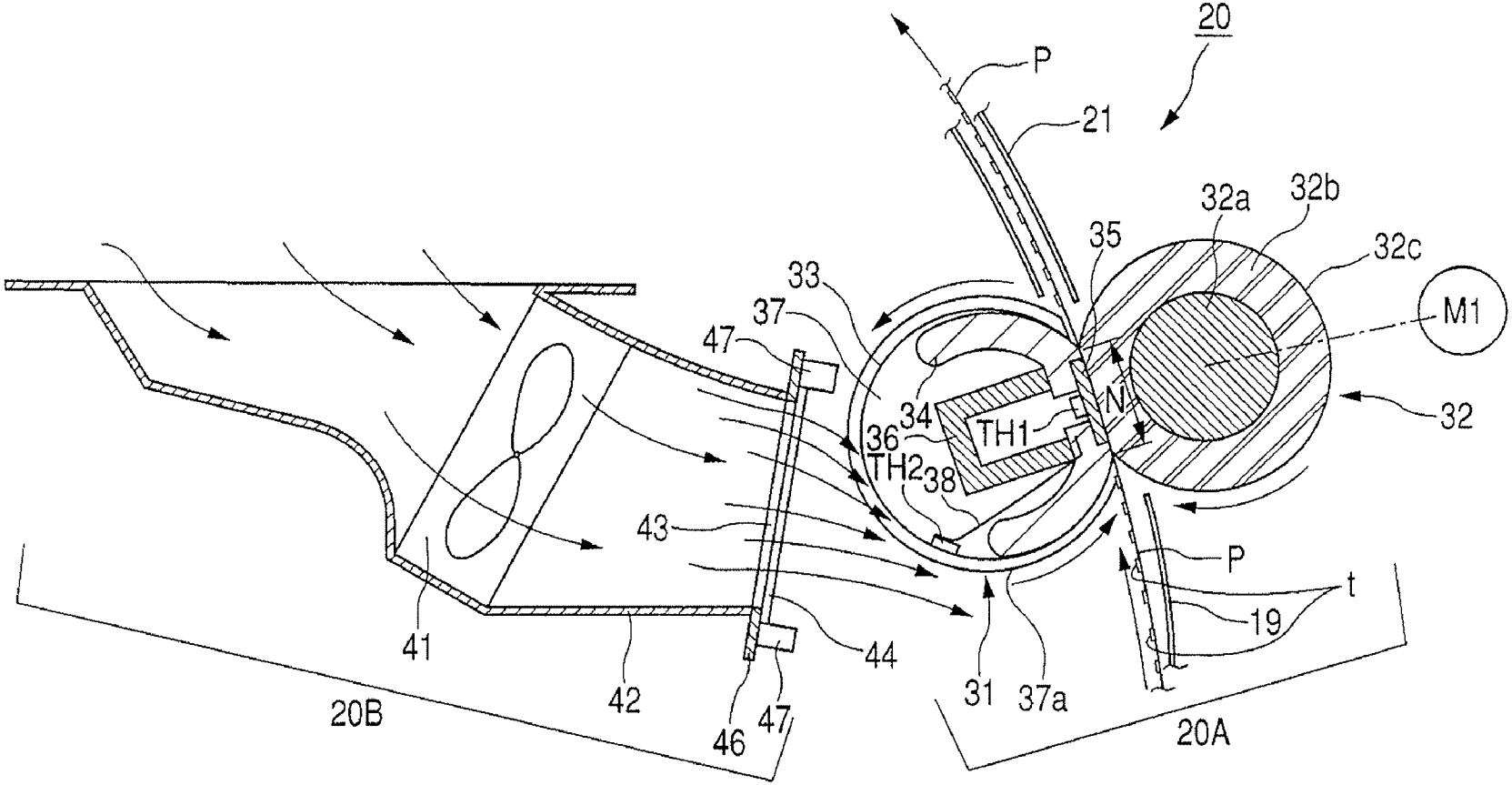
FIG. 1 is a cross-sectional view schematically showing a structure of a fixing apparatus (i.e., image heating apparatus) according to an embodiment.
Figure 3:
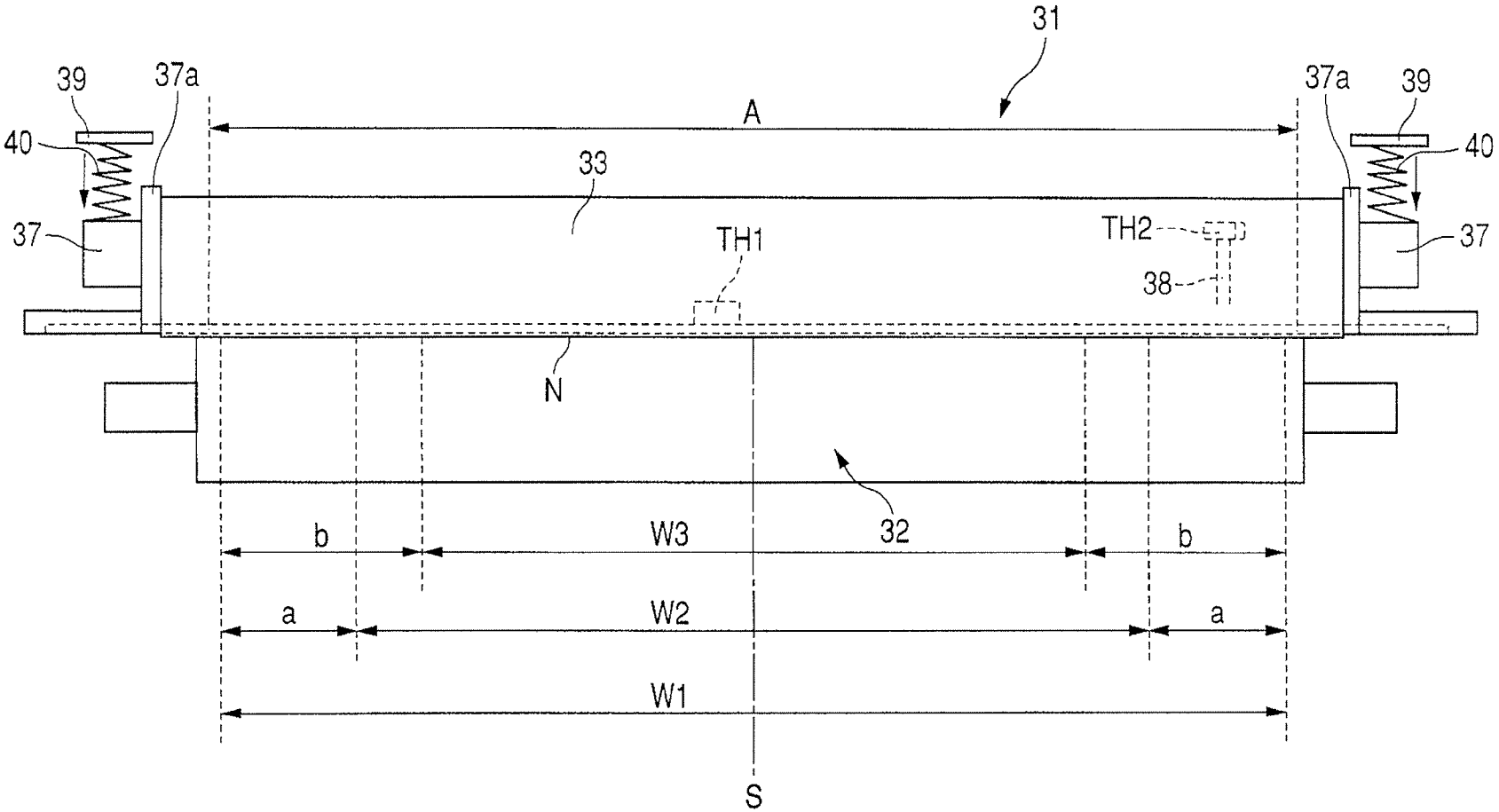
FIG. 3 is a front view schematically showing a fixing mechanism portion of the fixing apparatus.
Figure 4:
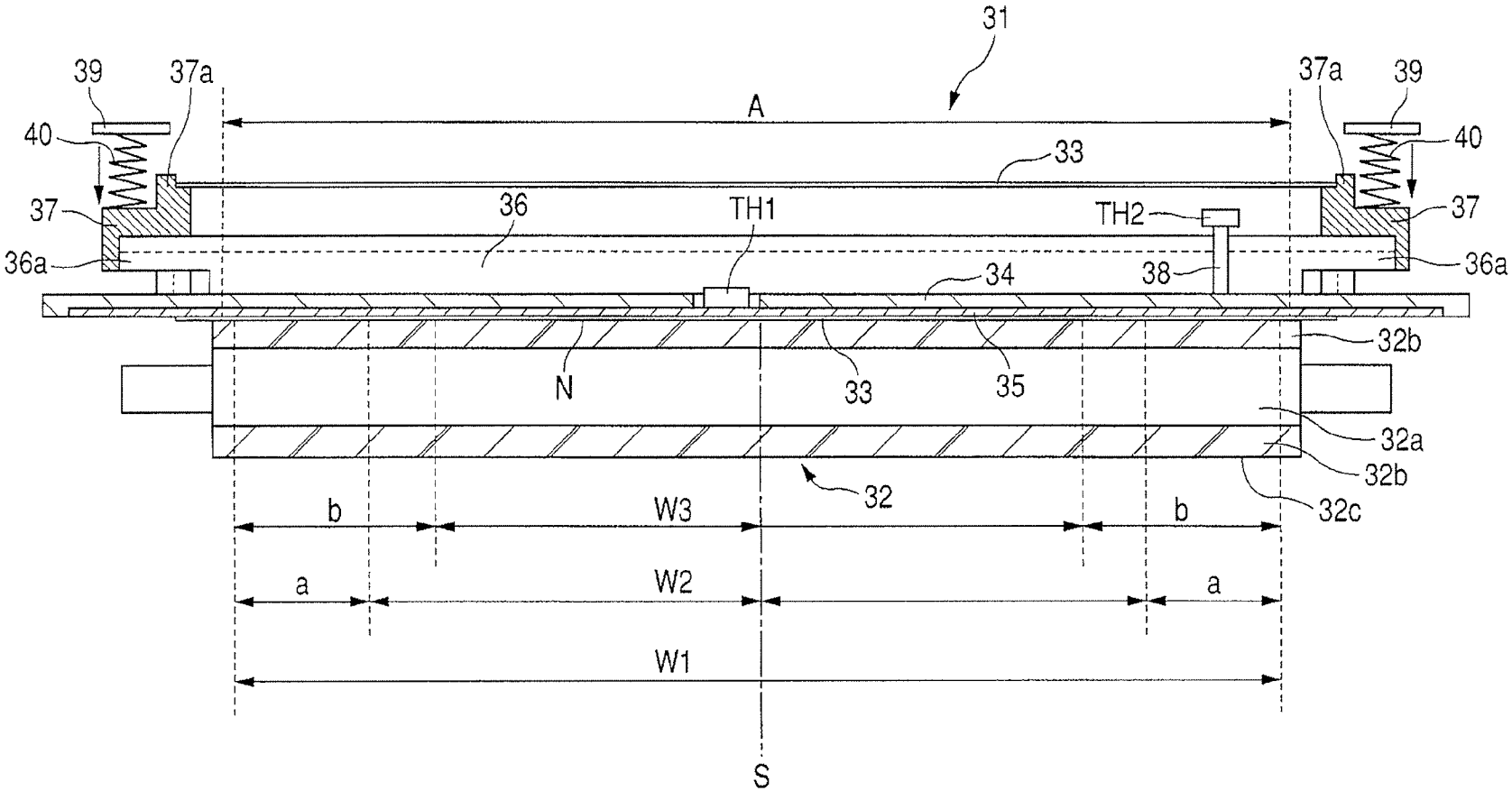
FIG. 4 is longitudinal sectional view schematically showing the front surface of the fixing mechanism portion.

FIG. 1 is a schematic cross-sectional view showing the structure of the fixing apparatus 20 serving as an image heating apparatus according to this embodiment. The fixing apparatus 20 is mainly composed of a film (i.e., belt) heating type fixing mechanism portion 20A and an air blowing/cooling mechanism portion 20B. FIG. 3 is a schematic diagram of a front surface of the fixing mechanism portion 20A, and FIG. 4 is a schematic longitudinal sectional view of the front surface of the fixing mechanism portion 20A.

(2-1) Fixing Mechanism Portion 20A

First, an outline of the fixing mechanism portion 20A will be described. The fixing mechanism portion 20A is basically a film heating type and pressure rotary member driving type (i.e., tensionless type) on-demand fixing apparatus, which is disclosed in JP H04-44075 A to JP H04-44083 A, JP H04-204980 A to JP H04-204984 A, and the like.

By pressure contact between a film assembly 31 serving as a first fixing member (i.e., heating member) and an elastic pressure roller 32 serving as a second fixing member (i.e., pressure member), a fixing nip (i.e., sheet passing nip) portion N is formed.

The film assembly 31 includes a cylindrical fixing film having flexibility (i.e., a fixing belt or a thin-walled roller; hereinafter, referred to simply as "film") 33 serving as a heating rotary member (i.e., image heating member), a heat-resistant and rigid film guide member 34 (hereinafter, referred to simply as "guide member") having a semi-circular trough-shaped cross section, and a ceramic heater (hereinafter, referred to simply as "heater") 35 serving as a heating source. The ceramic heater 35 is fitted into a concave groove provided for the guide member 34 along the longitudinal direction to be fixed onto an outer surface of the guide member 34. The film 33 is loosely fitted on the outer side of the guide member 34, to which the heater 35 is attached. A rigid pressure stay 36 having a U-shaped cross section (hereinafter, referred to simply as "stay") is provided inside the guide member 34. An end holder 37 is fitted into each of external projecting arms 36*a* on the right and left ends of the stay 36 to be attached thereto. A flange 37*a* is integrally formed with the end holder 37.

The pressure roller 32 has a cored bar 32*a* provided with an elastic layer 32*b* made of silicon rubber or the like, thereby lowering hardness thereof. In order to improve a surface property, a fluororesin layer 32*c* made of PTFE, PFA, FEP, or the like may be provided. The pressure roller 32 serving as a pressure rotary member is arranged such that both end portions of the cored bar 32*a* are rotatably held by a bearing member between side plates provided at left and right of an apparatus chassis (not shown).

The heater 35 side of the film assembly 31 is arranged to be opposed to the pressure roller 32 to thereby be in parallel to each other. A compression spring 40 is shrunk between the left and right end portion holders 37 and left and right fixed spring receiving members 39. As a result, the stay 36, the guide member 34, and the heater 35 are pressed and urged against the pressure roller 32 side. The pressing/urging force is set at a predetermined level, and the heater 35 is brought into pressure-contact with the pressure roller 32 against the elasticity of the elastic layer 32*b* through the film 33, thereby forming the fixing nip potion N having a predetermined width between the film 33 and the pressure roller 32 in the recording material transport direction.

Figure 5:
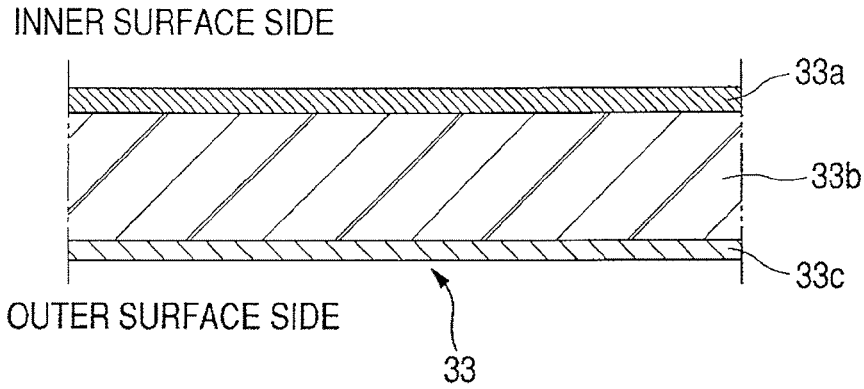
FIG. 5 is a schematic diagram showing a layer structure of a fixing film.

The film 33 according to this embodiment has, as shown in the schematic diagram of the layer structure of FIG. 5, a three-layer composite structure in which a base layer 33*a*, an elastic layer 33*b*, and a releasing layer 33*c* are provided in the order from an inner surface side to an outer surface side. For the base layer 33*a*, it is possible to use a heat-resistant film having a film thickness of 100 μm or less, preferably 50 μm or less and 20 μm or more, in order to reduce the heat capacity and improve the quick-start ability. For example, a film made of polyimide, polyimide-amide, PEEK, PES, PPS, PTFE, PFA, FEP, or the like may be used. In this embodiment, a cylindrical polyimide film having a diameter of 25 mm is used. For the elastic layer 33*b*, a silicone rubber having a rubber hardness of 10 degree (JIS-A), a heat conductivity of $4.18605\times10^{-1}$ W/m degree ($1\times10^{-3}$ [cal/cm. sec. deg.]), and a thickness of 200 μm is used. For the releasing layer 33*c*, a PFA coating layer having a thickness of 20 μm is used. Alternatively, a PFA tube may be used therefor. The PFE coating is excellent in that a thickness cannot be increased, and is more effective in coating toner as compared with the PFA tube in terms of a quality of a material. On the other hand, the PFA tube is more excellent than the PFA coating in terms of mechanical and electrical strengths, so both the PFA coating and the PFA tube can be used as the situation demands.

Figure 6:
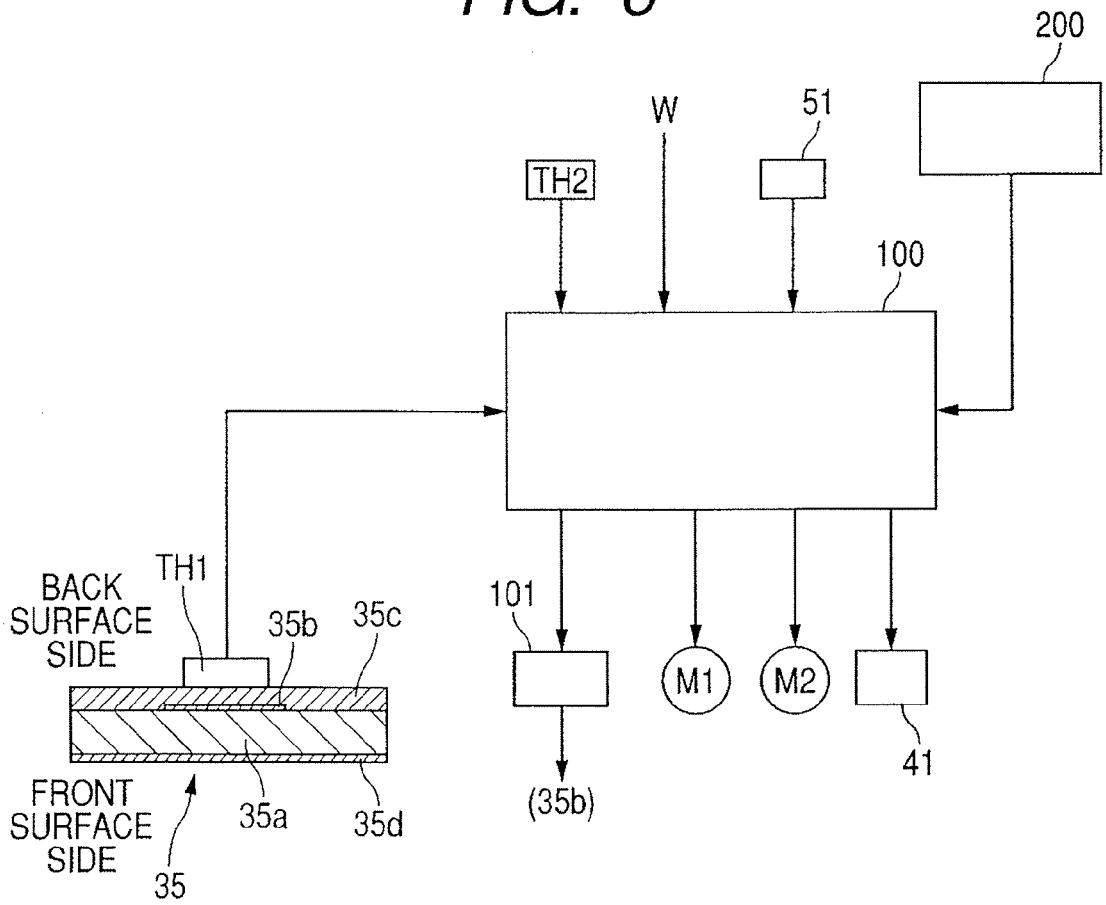
FIG. 6 is a cross-sectional view schematically showing a heater with a block diagram showing a control system.

The heater 35 according to this embodiment is of a back surface heating type using aluminum nitride and the like as a heater substrate, and is a horizontally-long linear heating member having a low heat capacity with a longitudinal side in a direction perpendicular to the movement direction of the fixing film 33 and the recording material P. FIG. 6 is a schematic cross-sectional view of the heater 35 with a block diagram of a control system of the heater 35. The heater 35 includes a heater substrate 35*a* made of aluminum nitride and the like. The heater substrate 35*a* includes an energizing heating layer 35*b* on the back surface side thereof (i.e., opposite surface side with the fixing film opposing surface side) which is provided along the longitudinal direction thereof, and is coated with an electrical resistance material such as argentum/palladium (Ag/Pd), with a thickness of about 10 μm and a width of 1 to 5 mm by screen printing or the like. Further, the heater 35 includes a protective layer 35*c* made of glass, a fluororesin, or the like on the energizing heating layer 35*b*. In this embodiment, on a front surface side of the heater substrate 35*a* (i.e., film opposing surface side), a sliding member (i.e., lubricating member) 35*d* is provided.

The heater 35 is fixingly supported by exposing the heater substrate surface side thereof provided with the sliding member 35*d* to be fitted into a groove portion which is provided along the longitudinal side of the guide at the substantial center of the outer surface of the guide member 34. In the fixing nip portion N, the surface of the sliding member 35*d* of the heater 35 and the inner surface of the belt 33 slide to be in contact with each other. Then, the belt 33 serving as a rotary image heating member is heated by the heater 35.

Figure 13:
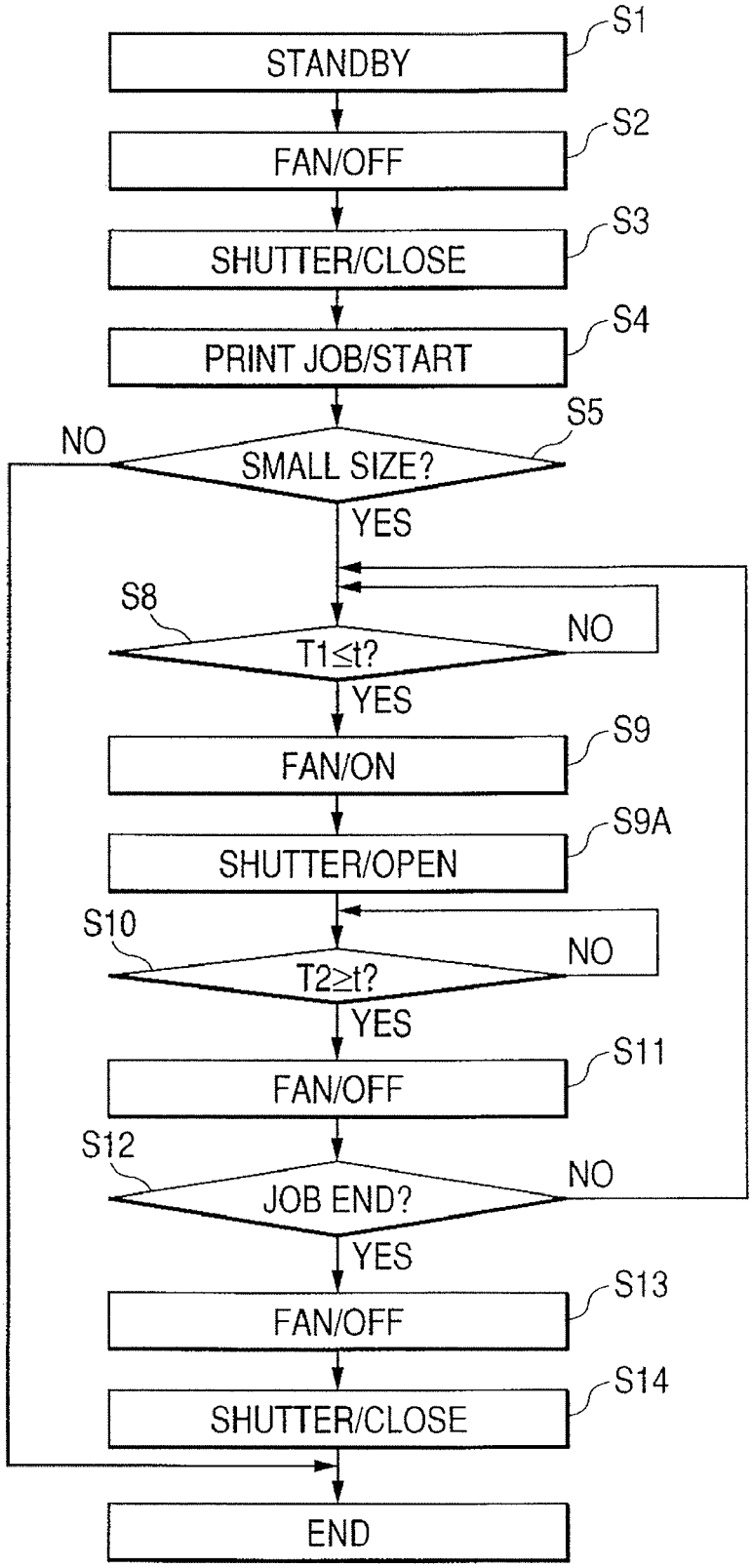
FIG. 13 is another operation sequence diagram.

The energizing heating layer 35*b* of the heater 35 is energized over longitudinal ends thereof, and the energizing heating layer 35*b* is heated to rapidly raise the temperature of the heater 35 in an entire area of an effective heat generation width A in the longitudinal direction of the heater. The temperature of the heater is detected by a first temperature sensor (i.e., first temperature detecting means; center temperature sensor) TH1 such as a thermistor which is arranged by being brought into contact with the outer surface of the heater protective layer 35*c*. Then an output of the detected temperature (i.e., signal value of the temperature) is inputted to the control circuit portion 100 through an A/D converter. The control circuit portion 100 controls energization from a power supply (i.e., power supply part, or heater driving circuit portion) 101 to the energizing heating layer 35*b* based on the detected temperature information to be inputted so as to maintain the temperature of the heater at a predetermined level. In other words, the temperature of the belt 33 serving as the image heating member heated by the heater 35 is controlled at a predetermined fixing temperature according to the output of the first temperature sensor TH1. In this embodiment, a proportional control system is adopted as a temperature control system. In the system, for example, as shown in FIG. 13, a set value (i.e., 220° C. in this embodiment) of the temperature of the heater and an electric power which is in proportion to a deviation of the temperature measured by the first temperature sensor TH1 is applied to the heater 35.

The pressure roller 32 is rotationally driven by a motor (i.e., drive means) M1 counterclockwise as indicated by the arrow. A torque acts on the belt 33 by a frictional force caused at the fixing nip portion N between the pressure roller 32 and the outer surface of the belt 33 due to the rotational driving of the pressure roller 32. As a result, the belt 33 is rotated around the guide member 34 in the counterclockwise direction indicated by the arrows while the inner surface thereof is sliding in close contact with the heater 35 (i.e., pressure roller driving method). The belt 33 is rotated at a circumferential speed substantially corresponding to a rotating circumferential speed of the pressure roller 32. Left and right flange portions 37*a* regulates an approaching movement by receiving the end portion of the belt at the approaching movement side when the rotating belt 33 is moved to approach leftward or rightward along the longitudinal side of the guide member 34. In order to reduce a mutual sliding frictional force generated in the fixing nip portion N between the heater 35 and the inner surface of the belt 33, the sliding member 35*d* is arranged on the surface of the heater in the fixing nip portion N, and a lubricant such as heat-resistant grease is mediated in the fixing nip portion N between the heater 35 and the inner surface of the belt 33.

Then, in response to a print start signal, the rotation of the pressure roller 32 is started, thereby starting heating-up of the heater 35. In a state where the rotating circumferential speed of the belt 33 is stabilized and the temperature of the heater 35 is raised at the predetermined temperature, the recording material P bearing a toner image "t" is introduced into the fixing nip potion N with the toner image bearing surface side as the belt 33 side. The recording material P is brought into close contact with the heater 35 through the belt 33 in the fixing nip portion N, thereby moving to pass the fixing nip portion N together with the belt 33. In the process of moving to pass the fixing nip portion N, the recording material P is provided with heat by the belt 33 heated by the heater 35, thereby heating and fixing the toner image "t" on the surface of the recording material P. The recording material P having passed the fixing nip portion N is separated from the surface of the belt 33 to be delivered and transported.

In this embodiment, transportation of the recording material P is performed by so-called central reference transportation in which the recording material is centered. In other words, with regard to any recording material with a variety of sizes in width which can pass the apparatus, a central portion of the recording material in the width direction thereof passes the central portion of the longitudinal direction of the fixing film 33. Reference symbol S denotes a recording material sheet passing reference line (i.e., virtual line).

Reference symbol W1 denotes a sheet passing width of the recording material having a maximum width (i.e., maximum sheet passing width) which can pass the apparatus. In this embodiment, the maximum sheet passing width W1 is an A3-size width of 297 mm (i.e., A3 portrait feed). The effective heat generation width A in the longitudinal direction of the heater is set to be slightly larger than the maximum sheet passing width W1. Reference symbol W3 denotes a sheet passing width of the recording material having a minimum width (i.e., minimum sheet passing width) which can pass the apparatus. In this embodiment, the minimum sheet passing width W3 is an A4R-size width of 210 mm (i.e., A4R portrait feed). Reference symbol W2 denotes a sheet passing width of the recording material having a width between the width of the maximum width recording material and the width of the minimum width recording material. In this embodiment, the sheet passing width W2 is a B4-size width of 257 mm (i.e., B4 portrait feed). Hereinafter, the recording material having a width corresponding the maximum sheet passing width is represented as a large-size recording material, and the recording material having a width smaller than the recording material having the maximum sheet passing width is denoted as a small-size recording material.

Reference symbol "a" denotes a differential width portion ((W1−W2)/2) between the maximum sheet passing width W1 and the sheet passing width W2, and reference symbol "b" denotes a differential width portion ((W1−W3)/2) between the maximum sheet passing width W1 and the minimum sheet passing width W3. In other words, each of the differential width portions "a" and "b" is a non-sheet passing portion generated when the B4 or A4R-size recording material, which is a small-size recording material, passes the apparatus. In this embodiment, the recording material sheet passing is performed by the central reference, so the non-sheet passing portions "a" and "b" are generated in left and right side portions of the sheet passing width W2 and in left and right side portions of the sheet passing width W3. The width of the non-sheet passing portion varies depending on the size of the width of the small-size recording material used for sheet passing.

The first temperature sensor TH1 is arranged to detect the temperature of the heater (i.e., temperature of the sheet passing portion) provided in the area corresponding to the minimum sheet passing width W3. A second temperature sensor TH2 (i.e., second temperature detecting means; end portion temperature sensor) such as a thermistor detects the temperature of the non-sheet passing portion. The output of the detected temperature (i.e., signal value of the temperature) is inputted to the control circuit portion 100 through an A/D converter. In this embodiment, the temperature sensor TH2 is arranged to be elastically in contact with an inner surface of a base layer of a film portion which corresponds to the non-sheet passing portion "a". To be specific, the temperature sensor TH2 is arranged at a free end of an elastic supporting member 38 having a shape of a plate spring to which a base of the guide member 34 is fixed. By elastically abutting the temperature sensor TH2 against the inner surface of the base layer 33*a* of the film 33 by the elasticity of the elastic supporting member 38, the temperature of the film portion corresponding to the non-sheet passing portion "a" is detected.

It should be noted that the first temperature sensor TH1 may be arranged to be elastically brought into contact with the inner surface of the base layer of the film portion corresponding to the sheet passing width W3. Meanwhile, the second temperature sensor TH2 may be arranged to detect the temperature of the heater corresponding to the non-sheet passing portion "a".

(2-2) Air Blowing/Cooling Mechanism Portion 20B

Figure 7:
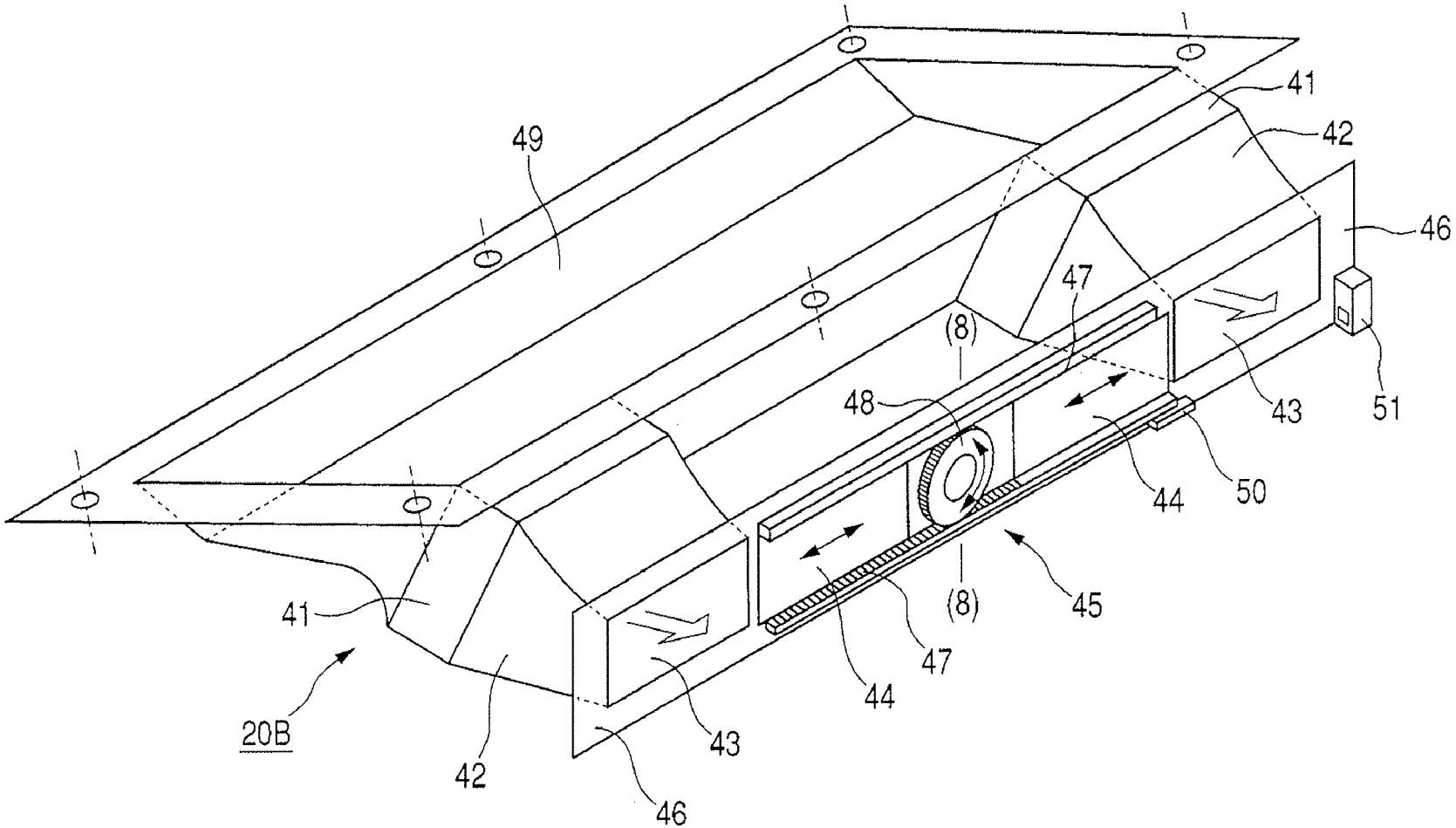
FIG. 7 is a perspective view schematically showing an external appearance of an air blowing/cooling mechanism portion.
Figure 8:
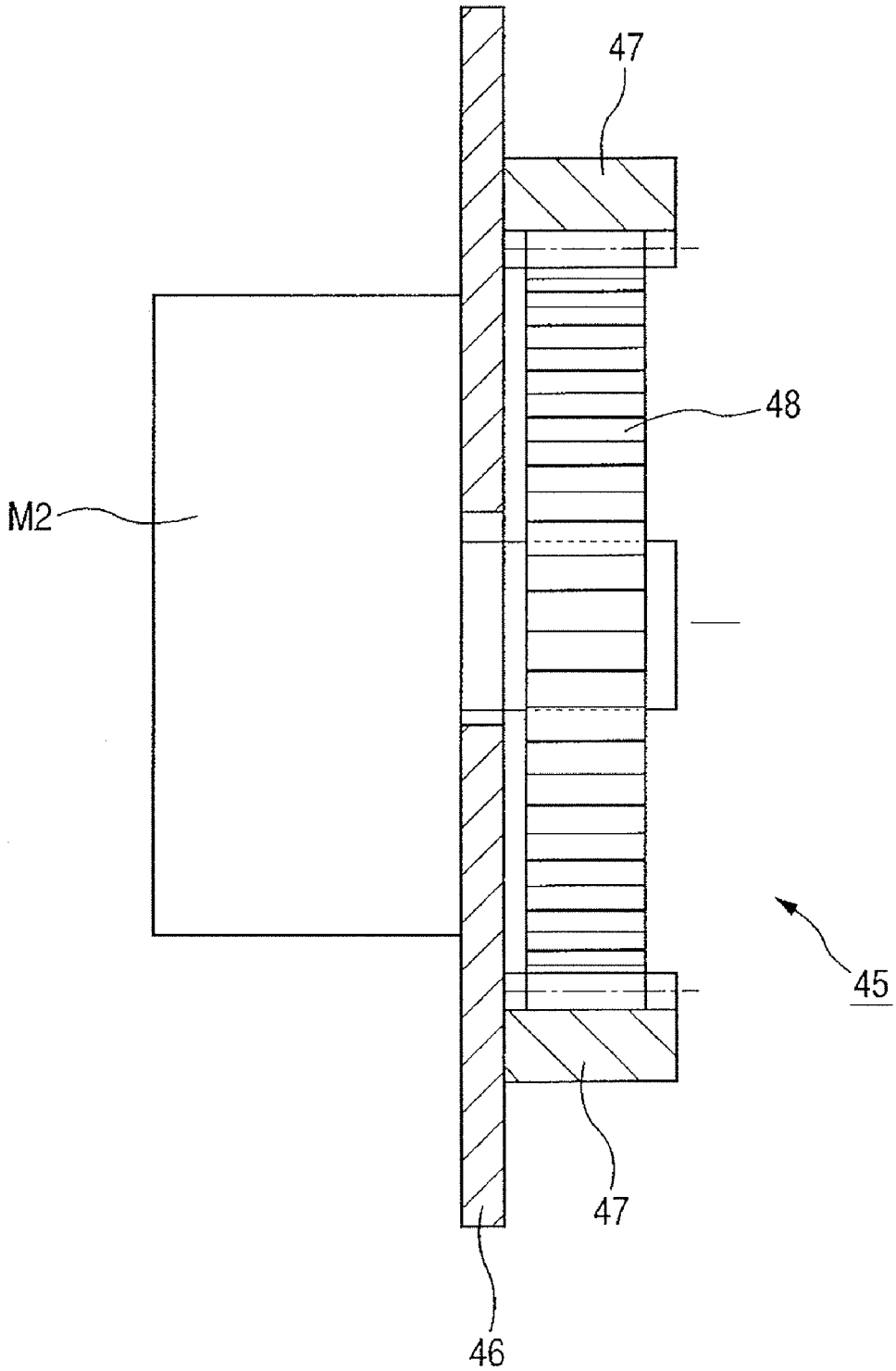
FIG. 8 is an enlarged view taken along the line (8)-(8) shown in FIG. 7.

The air blowing/cooling mechanism portion 20B cools, by blowing air, the raised temperature of the non-sheet passing portion of the fixing mechanism portion 20A, which is caused when continuous sheet passing (i.e., small size job) of small-size recording materials is performed. FIG. 7 is a schematic perspective view of an external appearance of the air blowing/cooling mechanism portion 20B. FIG. 8 is an enlarged view taken along the line of (8)-(8) shown in FIG. 7.

Referring to FIGS. 1, 7, and 8, the air blowing/cooling mechanism portion 20B according to this embodiment will be described. The air blowing/cooling mechanism portion 20B includes cooling fans (hereinafter, briefly referred to as "fan") 41 serving as cooling means. Further, the air blowing/cooling mechanism portion 20B includes air blowing ducts 42 for guiding air generated by the fans 41, and air blowing ports (i.e., air duct opening portions) 43 which are arranged in a portion opposing the film 33, which is an image heating member, of the fixing mechanism portion 20A of the air blowing ducts 42. Still further, the air blowing/cooling mechanism portion 20B includes shutters (i.e., shielding plates) 44 for regulating an opening width of the air blowing ports 43 as a width appropriate to the width of the recording material to be passed, and a shutter driving device (i.e., an opening width regulating means) 45 for driving the shutters 44.

The fans 41, the air blowing ducts 42, the air blowing ports 43, and the shutters 44 are arranged symmetrically with respect to the left and right portions of the film 33 in the longitudinal direction thereof. An intake channel portion 49 is arranged at an intake side of the fan 41. For the fan 41, a centrifugal fan such as a sirocco fan may be used.

The left and right shutters 44 are slidably supported in the horizontal direction along a plate surface of a supporting plate 46 extending in the horizontal direction thereof. The left and right shutters 44 are communicated with each other by providing racks 47 and a pinion gear 48, and the pinion gear 48 is driven by a normal rotation or a reverse rotation by a motor (i.e., pulse motor) M2. As a result, the left and right shutters 44 are operated in association with each other, thereby being opened/closed in a symmetrical relation with respect to the air blowing ports 43 each corresponding thereto. The shutter driving device 45 is constituted of the supporting plate 46, the racks 47, the pinion gear 48, and the motor M2.

The left and right air blowing ports 43 are provided between a position which is a little close to the center from the non-sheet passing portion "b", which is generated when the minimum width recording material is passed, and the maximum sheet passing width W1. The left and right shutters 44 are arranged in a direction in which the air blowing ports 43 are closed outward from a longitudinal middle part of the supporting plate 46 by a predetermined amount.

To the control circuit portion 100, based on information such as an input of a size of a recording material to be used by a user, and a recording material width automatic detecting mechanism (not shown) of a sheet feeding cassette 13 or the manual feed tray 17, width information W (see FIG. 6) of a recording material to be passed is input. Then, the control circuit portion 100 controls the shutter driving device 45 based on the information. In other words, the pinion gear 48 is rotated by driving the motor M2, and the shutters 44 are moved by the racks 47, thereby making it possible to open the air blowing ports 43 by the predetermined amount.

Figure 9:
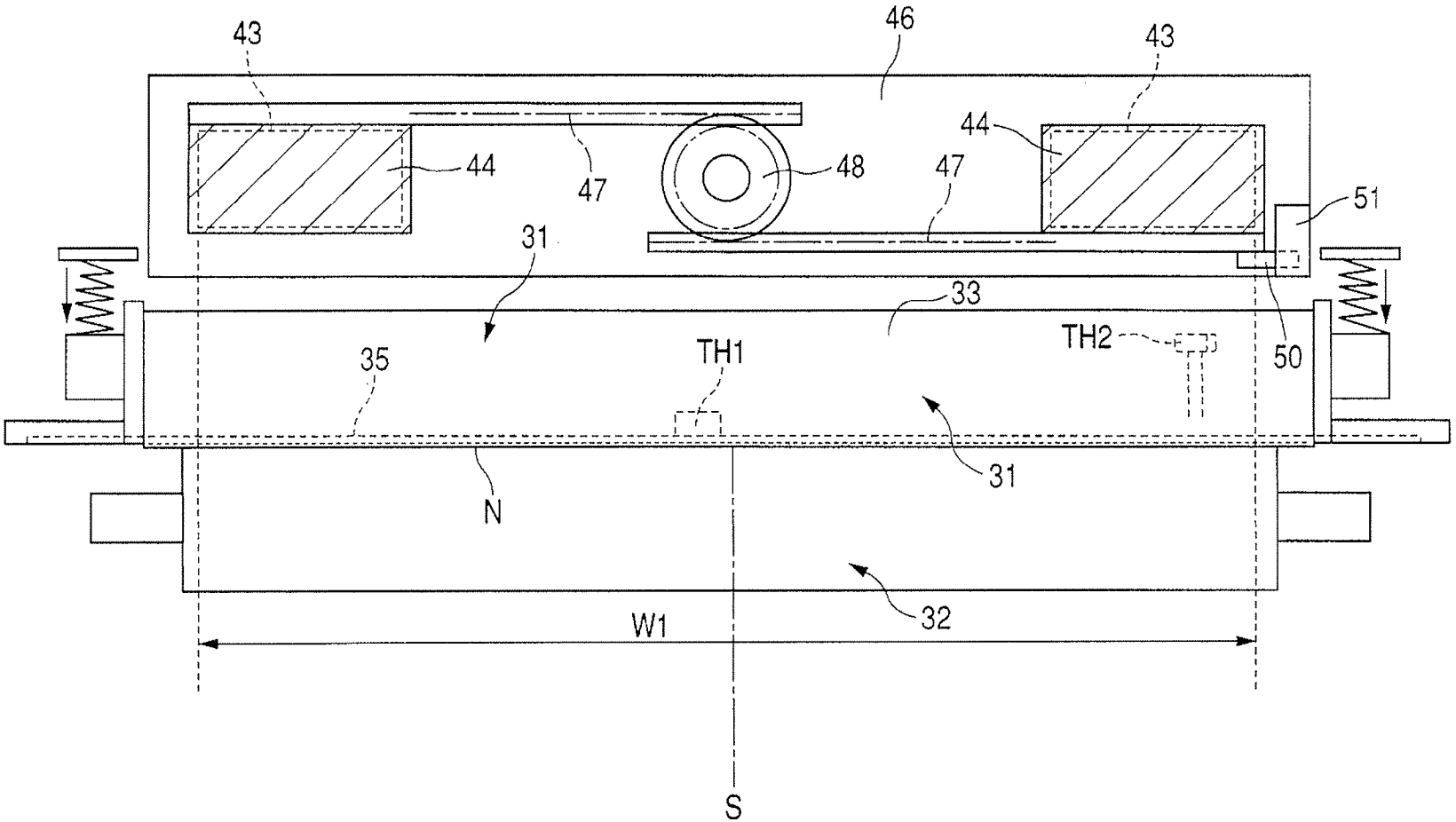
FIG. 9 is a constitutional diagram showing a state in which shutters are each moved to a fully-closed position in which air blowing ports are fully closed.
Figure 10:
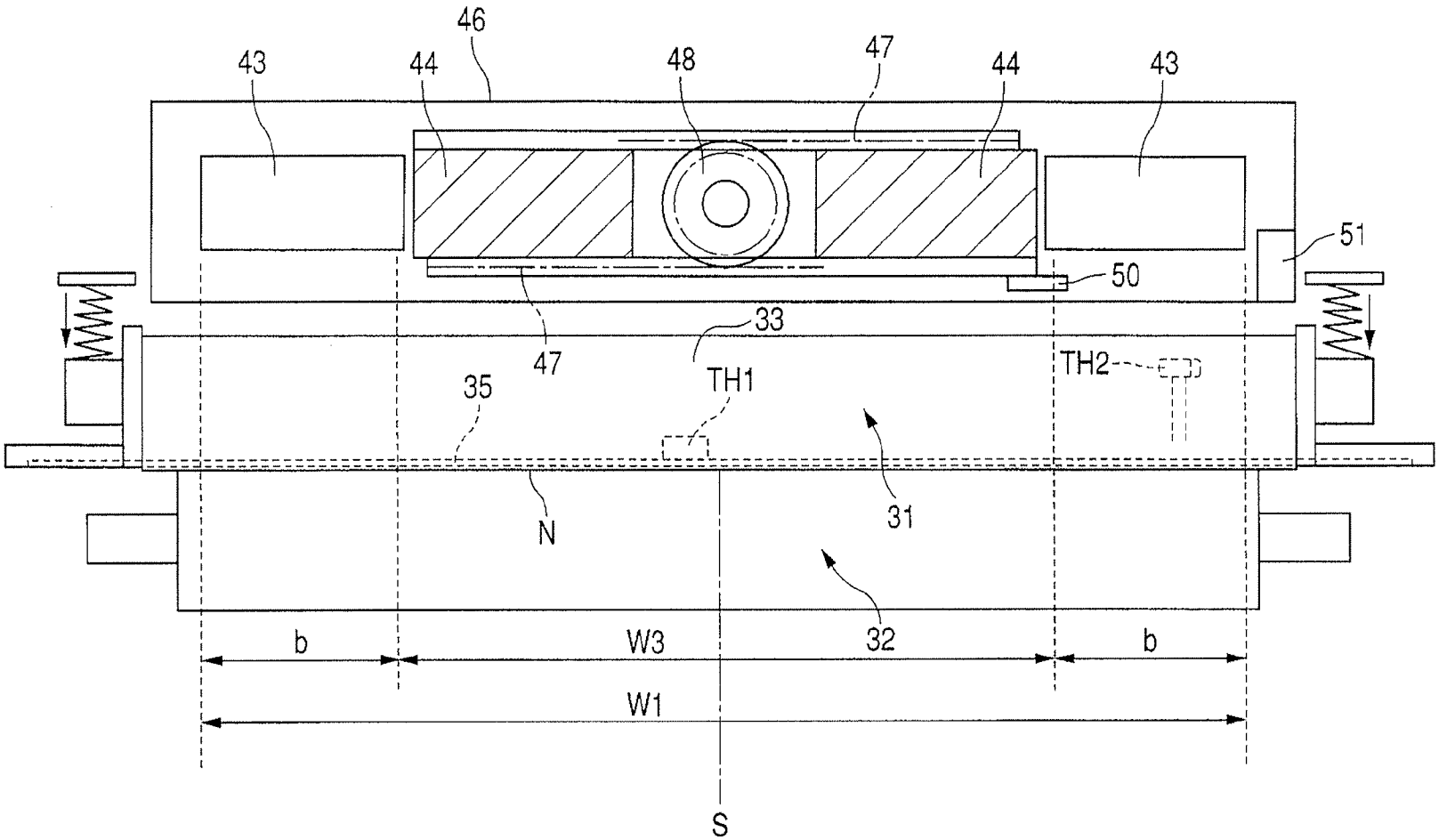
FIG. 10 is a constitutional diagram showing a state in which the shutters are each moved to a fully-opened position in which the air blowing ports are fully opened.
Figure 11:
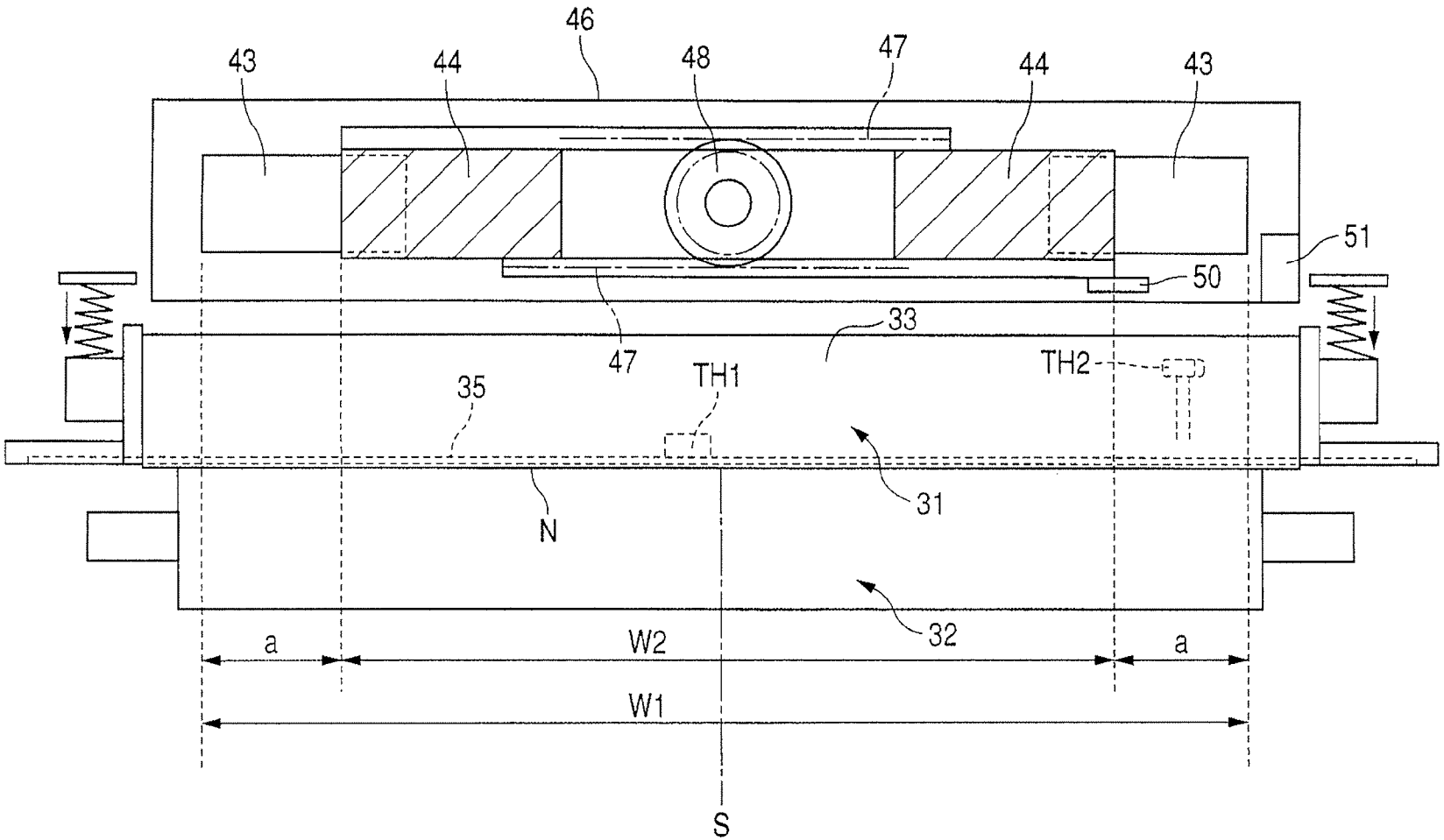
FIG. 11 is a constitutional diagram showing a state in which the shutters are each moved to a position in which only a portion of the air blowing port corresponding to a non-sheet passing portion "a" is opened.

The control circuit portion 100 controls the shutter driving device 45 to move the shutters 44 to a fully-closed position where the air blowing ports 43 are fully closed, as shown in FIG. 9, when the width information of the recording material indicates a large-size recording material of an A3-size width. On the other hand, the control circuit portion 100 controls the shutter driving device 45 to move the shutters 44 to a fully-opened position where the air blowing ports 43 are fully opened, as shown in FIG. 10, when the width information of the recording material indicates a small-size recording material of an A4R-size width. When the width information of the recording material indicates a small-size recording material of a B4-size width, as shown in FIG. 11, the control circuit portion 100 controls the shutter driving device 45 to move the shutters 44 to a position where only a portion of the air blowing ports 43, which corresponds to the non-sheet passing portion "a", is opened.

It should be noted that, not shown in the drawings, in a case where the small-size recording material to be passed is LTR-R, EXE, K8, LTP, or the like, the control circuit portion 100 controls the shutter driving device 45 to move the shutters 44 to a position where the portion of the air blowing ports, which corresponds to the non-sheet passing portion, is opened.

To be specific, the opening width of the air blowing port 43 can be varied by moving the shutter 44 in accordance with a length of the recording material in the width direction.

The minimum, maximum and full sheet sizes in this embodiment are specification sheets guaranteed by the image forming apparatus main body, and not undefined sized sheets used by the user for his/her own purpose.

To detect positional information on the shutters 44, a sensor 51 arranged on the supporting plate 46 detects a flag 50 arranged at a predetermined position of the shutter 44. To be specific, as shown in FIG. 9, a home position is set at a shutter position where the air blowing ports 43 are fully closed, thereby detecting the opening amount based on a rotational amount of the motor M2.

It is also possible that an opening width detecting sensor for directly detecting current positions of the shutters 44 is provided, and a shutter position information detected by the sensor is fed back to the control circuit, thereby controlling the shutters 44 to move to an appropriate opening width position corresponding to the width of the recording material to be passed. A stop position of the shutter corresponding to the length in the width direction of the small-size recording material with high precision by detecting an edge position of the shutter by the sensor. Accordingly, it is possible to blow cooling air only for the non-sheet passing area of any small-size recording material.

(2-3) Operation Sequence of the Air blow Cooling Mechanism Portion 20B

Figure 12:
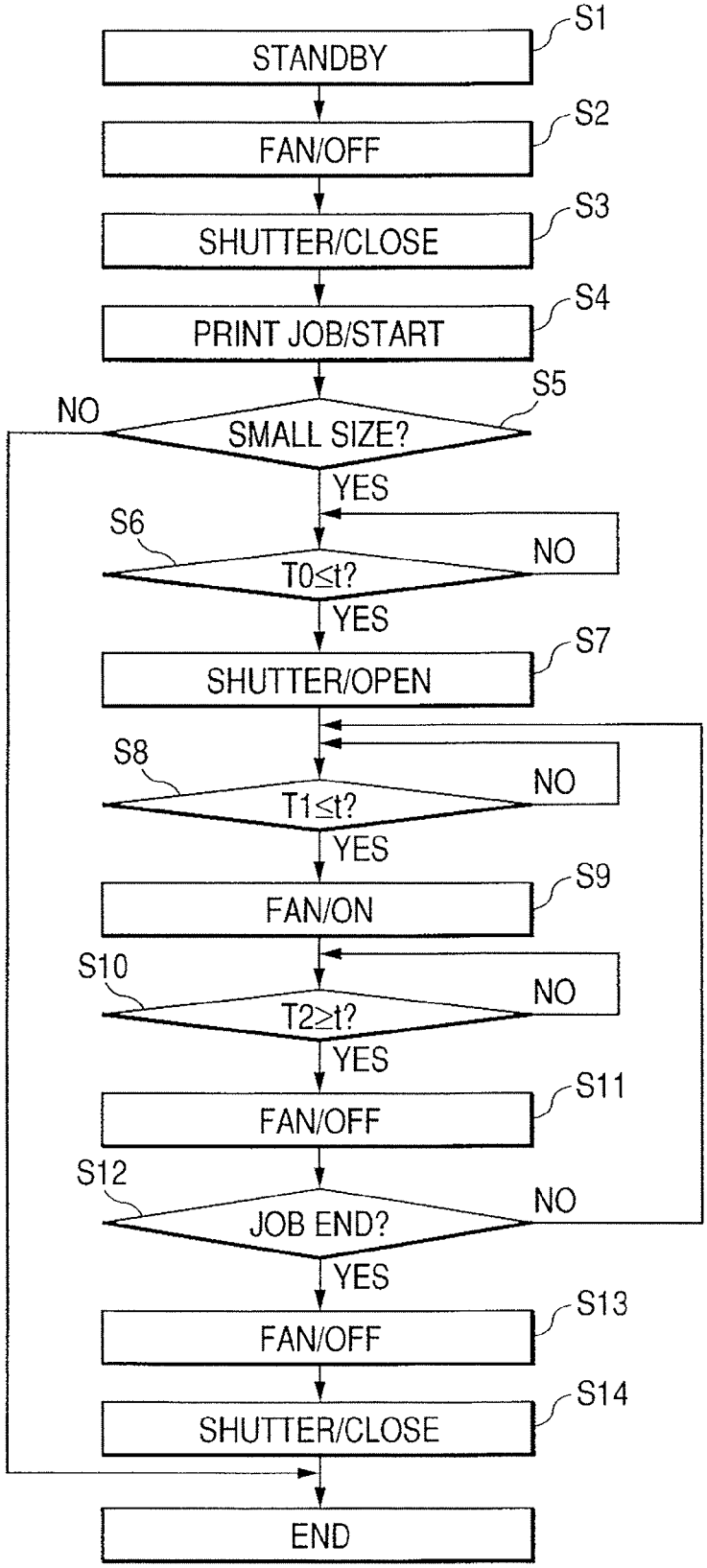
FIG. 12 is an operation sequence diagram of an air blow cooling mechanism portion in a first embodiment.

An operation sequence of the air blow cooling mechanism portion 20B, which is performed by the control circuit part 100 in this embodiment, will be described with reference to FIG. 12.

Steps S1 to S3: In a standby state of the printer, cooling is not required and therefore a cooling operation is not performed. In this case, the fan 41 serving as the air blowing means is in an off state. The shutter 44 is kept at the home position, i.e., in a fully-closed state where the air blowing port 43 is fully closed, as shown in FIG. 9.

Step S4: A print job is started.

Step S5: The size of the recording material used as a passing sheet is determined. When the recording material is a large-size recording material corresponding to the maximum sheet passing width W1 (in this embodiment, the A3-size sheet), cooling is not required and therefore the cooling operation is not performed. To be specific, the cooling fan 41 is kept in the off state, whereas the shutter is kept in the fully-closed state.

Step S6: when the recording material is a small-size recording material (for example, A4R, B5 or the like), a temperature "t" of the non-sheet passing portion, which is detected by the second temperature sensor (temperature detecting element) TH2, is monitored.

When the temperature "t" of the non-sheet passing portion is equal to or lower than a predetermined first reference temperature T0, the cooling fan 41 is still kept in the off state and the shutter 44 is kept in the fully-closed state (at the closed position).

Step S7: When the temperature "t" of the non-sheet passing portion exceeds the predetermined first reference temperature T0, the shutter driving apparatus 45 is controlled to move the shutter 44 to open the air blowing port 43 by a portion corresponding to the non-sheet passing portion of the passing small-size recording material. The fan 41 still remains in the off state.

Step S8: Furthermore, the temperature "t" of the non-sheet passing portion, which is detected by the second temperature sensor TH2, is monitored.

Step S9: When the temperature "t" of the non-sheet passing portion exceeds a predetermined second reference temperature T1 higher than the first reference temperature T0, the fan 41 is switched on. To be specific, the cooling operation is started in this step. As a result, the temperature rise portion of the non-sheet passing portion of the film 33 in the fixing mechanism portion 20A is cooled with a cooling air from the air blowing port 43.

Step S10: The temperature "t" of the non-sheet passing portion, which is detected by the second temperature TH2, is further monitored.

Until the second temperature TH2 detects that the temperature "t" of the non-sheet passing portion is lowered by the air blow cooling to a predetermined third reference temperature T2 or lower, which is equal to or lower than the second reference temperature T1 and higher than the first reference temperature T0, the fan 41 is operated to continue the cooling operation.

Step S11: When the second temperature sensor TH2 detects that the temperature "t" of the non-sheet passing portion is lowered to the third reference temperature T2 or lower, the fan 41 is switched off. To be specific, the cooling operation is stopped. The position of the shutter 44 is maintained.

Step S12: Unless the print job is finished, the repeated on/off control of the fan 41 is performed by repeating Steps S8 to S11. To be specific, by the repeated on/off control of the cooling operation, a temperature rise of the non-sheet passing portion is adjusted to be between the second reference temperature T1 or lower and the third reference temperature T2 or higher.

Steps S13 and S14: Upon the end of the print job, the fan 41 is switched off if the fan 41 is in the on state at the end of the print job. In addition, the shutter 44 is restored to the home position, i.e., to the fully-closed state where the air blowing port 43 is fully closed.

In the operation sequence described above, the shutter 44 is kept at the closed position with respect to the air blowing port 43 when the fan 41 is not in operation except for the off state of the fan 41 during the execution of the print job for the small-size recording material (Step S11). To be specific, the shutter 44 shields the fixing mechanism portion 20A and the fan 41 serving as the air blowing means.

As a result, the shutter 44 can be prevented from being opened other than during the cooling operation not to excessively increase the temperature of the fan 41, not to cause a failure of the fan 41 or not to shorten the lifetime of the fan 41 by an ambient temperature rise caused by the heat from the fixing mechanism portion 20A.

To be specific, with the air blow cooling mechanism 20B including the small duct and the fan, the fixing apparatus, which does not lower the productivity even when the small-size recording materials are continuously passed, can be provided.

In the embodiment described above, the shutter 44 is first opened at the temperature equal to or lower than the second reference temperature T1 and higher than the first reference temperature T0 in Steps S6 and S7 to achieve an optimal open state in the earlier stage. As a result, the cooling with the fan can be started as soon as the temperature of the non-sheet passing portion exceeds the second reference temperature T1 which requires the cooling.

If the opening/closing operation time of the shutter 44 is short and the optimal open state can be achieved as soon as the temperature of the non-sheet passing portion reaches the second reference temperature T1 requiring the cooling, an operation sequence with T0=T1 as shown in FIG. 13 is preferred. To be specific, as in Steps S8, S9, and S9A shown in FIG. 13, simultaneously with the switch-on of the fan 41, the shutter 44 is moved to the position that opens the air blowing port 43 by a portion corresponding to the non-sheet passing portion of the small-size recording material to be passed.

It is not necessarily required to open/close the shutter 44 or to switch the fan 41 on/off in accordance with the result of detection of the temperature by the second temperature sensor TH2 which detects the temperature of the non-sheet passing portion. For example, in accordance with the number of small-size recording materials to be continuously passed, the shutter 44 is kept at the closed position until the number of small-size recording materials, which allows the temperature to reach the temperature requiring the cooling of the non-sheet passing portion, passes through the fixing nip portion N. The sequence may also be such that the shutter 44 is opened and the fan 41 is switched on to start the cooling operation after the passage of a predetermined number of recording materials.

Second Embodiment

In this embodiment, even when the fan 41 is in the off state during the execution of the print job of the small-size recording material, the shutter 44 is temporarily restored to the home position to be put into a fully-closed state.

Figure 14:
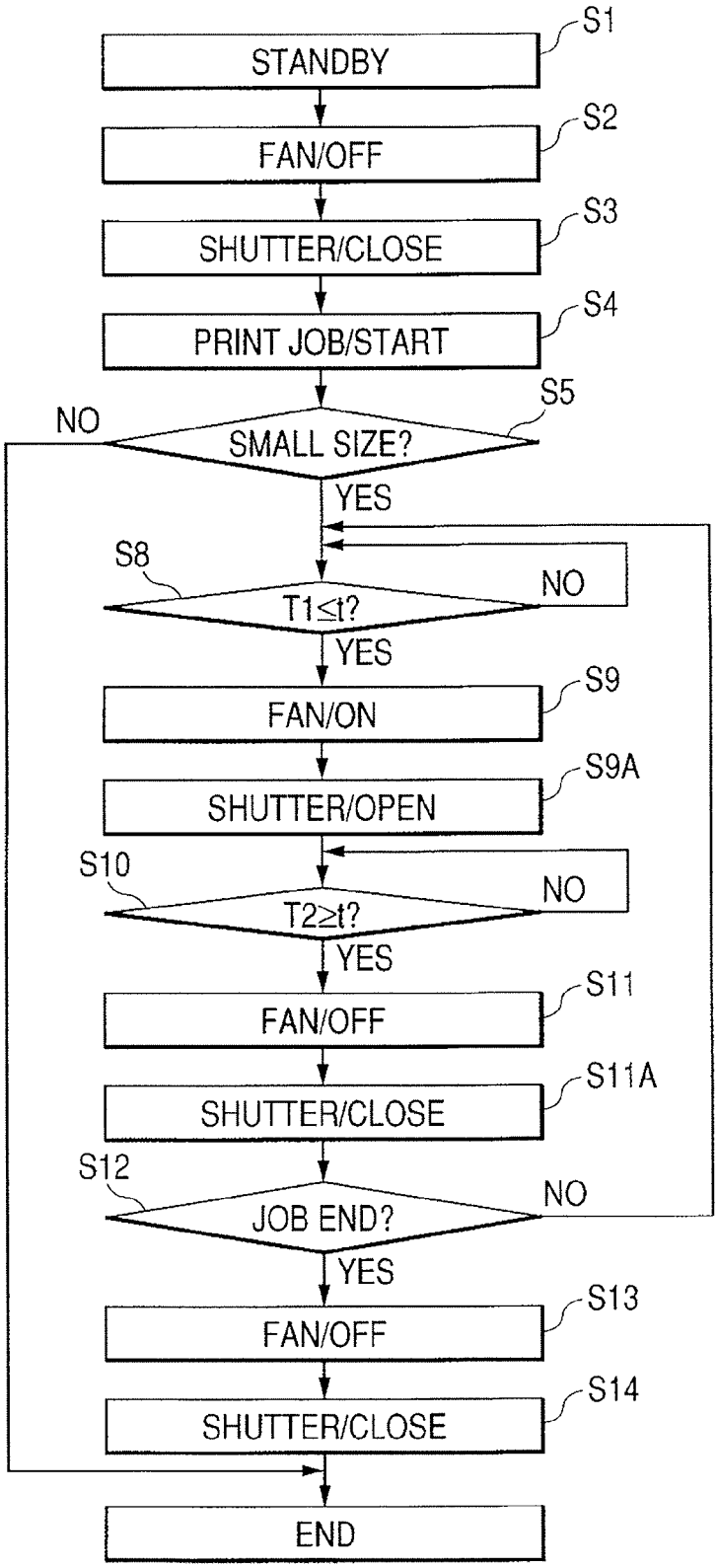
FIG. 14 is an operation sequence diagram of an air blow cooling mechanism portion in a second embodiment.
Figure 15:
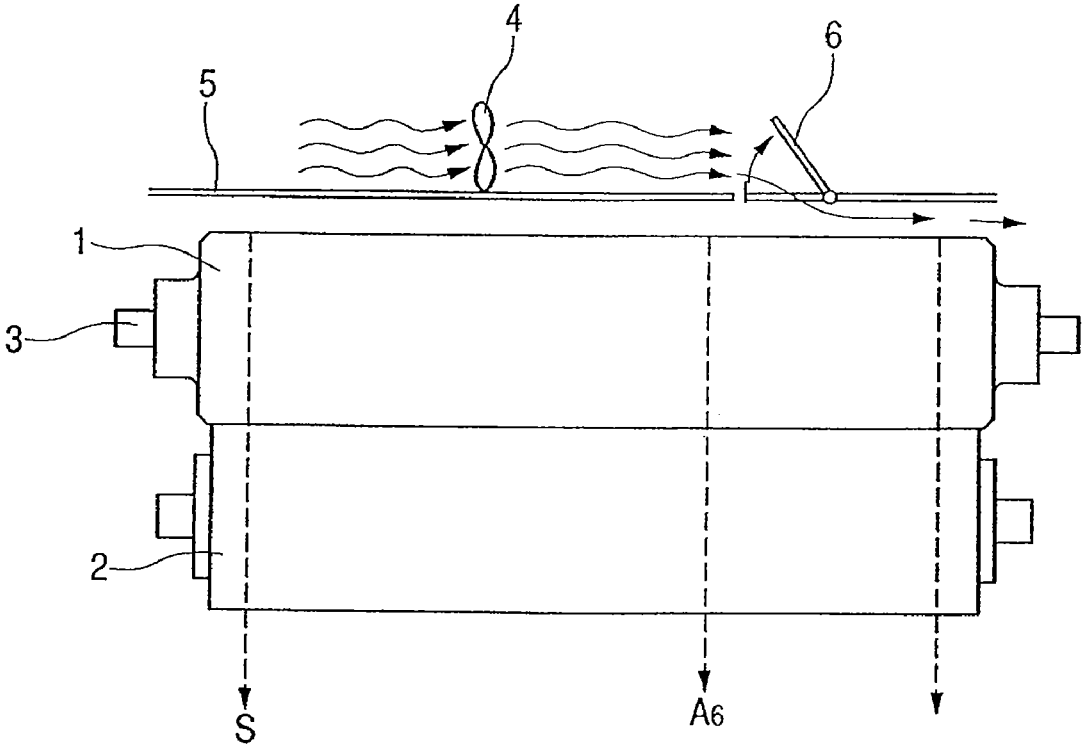
FIG. 15 PRIOR ART
FIG. 15 is a configuration view according to a conventional example.

FIG. 14 shows the same operation sequence as that in FIG. 13 except that the shutter 44 is temporarily restored to the home position to be in a fully-closed state as in Step S11A substantially simultaneously with the switch-off of the fan 41 in Step S11. Unless the print job is finished, the repeated on/off control of the fan 41 is performed by repeating Steps S8 to S11A. Each time, the opening operation (S9A) and the closing operation (S11A) of the shutter 44 are performed. To be specific, a temperature rise of the non-sheet passing portion is adjusted between the second reference temperature T1 and the third temperature T2.

As described above, in accordance with on/off of the fan, by closing the shutter 44 whenever the fan is in the off state, the ambient temperature of the fan can be kept at a lower temperature to contribute to an increased lifetime of the fan.

As described in the first and second embodiments, when the fan 41 serving as the air blowing means is not required to be switched on, that is, the non-sheet passing portion is not required to be cooled, the shutter 44 of the air blowing port is kept at the closed position. As a result, the ambient temperature of the fan 41 can be controlled not to be raised by the heat from the fixing mechanism portion 20A. The cases where the fan 41 is not required to be switched on correspond to, for example, 1) the passage of the large-size recording material, 2) the passage of a small number of small-size recording materials, and 3) the end of a job when the passage of the last recording material of a predetermined number of small-size recording materials is finished.

When the fan 41 is not in operation (i.e., not in the on state), the ambient temperature of the fan 41 does not rise because the fixing mechanism 20A and the fan 41 are shielded. Therefore, the lifetime of the fan 41 is not shortened even in the small air blow cooling mechanism portion 20B to efficiently prevent the temperature of the non-sheet passing portion from rising. As a result, the image heating apparatus that prevents the productivity for the continuous passage of small-size recording materials from being lowered can be provided.

In order to keep energy consumption down, an image heating apparatus which reduces a heat capacity of the image heating apparatus to shorten a warm-up time has been proposed in recent years. In particular, in the image heating apparatus having a small heat capacity as described above, the temperature of the non-sheet passing portion is likely to excessively rise by the passage of the small-size recording materials. Thus, the configuration of the present invention is effective.

Although the heating rotary member (i.e., image heating member) 33 is a thin-walled roller type member with a small heat capacity in the above description, the heating rotary member is not particularly limited thereto. The same effect can be obtained even with a belt type member.

The fixing mechanism portion 20A is not limited to the film heating type heating apparatus described in the above embodiments, but can also be a heat roller type heating apparatus or heating apparatuses of other configurations. The fixing mechanism portion 20A may also be an electromagnetic induction heating type apparatus.

The same effect can be obtained even when the fixing mechanism portion 20A has a configuration in which the recording material is passed based on the one-sided transfer standard.

Although the fixing apparatus has been described above as an example of the image heating apparatus, the present invention is also applicable to a gloss improving apparatus for heating an image fixed onto the recording material to improve the gloss of the image and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2005-265879, filed Sep. 13, 2005, which is hereby incorporated by reference herein in its entirety.

What is claimed is:

1. An image heating apparatus, comprising:

an image heating member that heats an image on a recording material in a nip portion;

a duct provided with an air blowing port;

a fan that blows air toward the air blowing port through the duct to cool a predetermined area of the image heating member;

a shutter that opens and closes the air blowing port;

a detector that detects a temperature of the predetermined area of the image heating member; and a controller that keeps the shutter at a closed position until a detected temperature by the detector reaches a predetermined temperature after an image heating process is started.

2. An image heating apparatus according to claim 1, wherein the controller starts an air blowing operation of the fan after the shutter is opened.

3. An image heating apparatus according to claim 2, wherein the controller opens the shutter after the detected temperature by the detector reaches a first temperature after the image heating process is started, and the controller starts the air blowing operation of the fan after the detected temperature by the detector reaches a second temperature higher than the first temperature.

4. An image heating apparatus, comprising:

an image heating member that heats an image on a recording material in a nip portion;

a duct provided with an air blowing port;

a fan that blows air toward the air blowing port through the duct to cool a predetermined area of the image heating member;

a shutter that opens and closes the air blowing port; and a controller that opens the shutter after a temperature of the predetermined area reaches a predetermined temperature, and starts an air blowing operation of the fan after the shutter is opened.

5. An image heating apparatus according to claim 4, wherein the controller opens the shutter after the temperature of the predetermined area reaches a first temperature, and the controller starts the air blowing operation of the fan after the temperature of the predetermined area reaches a second temperature higher than the first temperature.

* * * * *